US007468007B2

(12) United States Patent
Simonds et al.

(10) Patent No.: US 7,468,007 B2
(45) Date of Patent: Dec. 23, 2008

(54) DUAL DIMPLE SURFACE GEOMETRY FOR A GOLF BALL

(75) Inventors: Vincent J. Simonds, Brimfield, MA (US); Thomas F. Bergin, Holyoke, MA (US); Thomas A. Veilleux, Charlton, MA (US); Erich Muhlanger, Rocky Hill, MA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 11/830,058

(22) Filed: Jul. 30, 2007

(65) Prior Publication Data

US 2008/0015056 A1 Jan. 17, 2008

Related U.S. Application Data

(63) Continuation of application No. 11/554,184, filed on Oct. 30, 2006, now Pat. No. 7,250,012.

(51) Int. Cl.
*A63B 37/12* (2006.01)

(52) U.S. Cl. ..... 473/383

(58) Field of Classification Search ..... 473/383–385
See application file for complete search history.

(56) References Cited

U.S. PATENT DOCUMENTS

| | | | | |
|---|---|---|---|---|
| 2,002,726 | A | 5/1935 | Young | |
| 4,266,773 | A | 5/1981 | Treadwell | |
| 4,722,529 | A | 2/1988 | Shaw et al. | |
| 4,787,638 | A | 11/1988 | Kobayashi | |
| 5,143,377 | A | 9/1992 | Oka et al. | |
| 5,338,039 | A | 8/1994 | Oka et al. | |
| 5,377,989 | A | 1/1995 | Machin | |
| 5,470,076 | A | 11/1995 | Cadorniga | |
| 5,536,013 | A | 7/1996 | Pocklington | |
| 5,722,903 | A | 3/1998 | Moriyama et al. | |
| 6,139,448 | A | 10/2000 | Sullivan | |
| 6,290,615 | B1 | 9/2001 | Ogg | |
| 6,315,686 | B1 | 11/2001 | Barfield | |
| 6,475,106 | B1 | 11/2002 | Green et al. | |
| 6,503,158 | B2 | 1/2003 | Murphy et al. | |
| 6,569,038 | B2 | 5/2003 | Sullivan | |
| 6,626,772 | B1 | 9/2003 | Kennedy, III | |
| 6,749,525 | B2 | 6/2004 | Aoyama | |
| 7,354,359 | B2 * | 4/2008 | Sajima | 473/383 |
| 2004/0198536 | A1 * | 10/2004 | Ohama et al. | 473/378 |

* cited by examiner

*Primary Examiner*—Raeann Trimiew
(74) *Attorney, Agent, or Firm*—Michael A. Catania; Elaine H. Lo

(57) ABSTRACT

A golf ball (20) having a plurality of primary dimples (50) with annular tubular portion (60) is disclosed herein. In a preferred embodiment, there are 332 primary dimples which cover a surface area ranging from 81% to 87% of the golf ball (20). Also in a preferred embodiment, there are twenty different types of primary dimples (50), which vary in diameter, chord depth and/or entry angle.

3 Claims, 7 Drawing Sheets

DUAL DIMPLE SURFACE GEOMETRY FOR A GOLF BALL

CROSS REFERENCES TO RELATED APPLICATIONS

The Present Application is a continuation application of U.S. patent application Ser. No. 11/554,184, filed on Oct. 30, 2006, which claims priority to U.S. Provisional Patent Application No. 60/806,955, filed on Jul. 11, 2006.

STATEMENT REGARDING FEDERALLY SPONSORED RESEARCH OR DEVELOPMENT

Not Applicable

BACKGROUND OF THE INVENTION

1. Field of the Invention

The present invention relates to an aerodynamic surface geometry for a golf ball. More specifically, the present invention relates to a golf ball having a dual dimple surface geometry.

2. Description of the Related Art

Golfers realized perhaps as early as the 1800's that golf balls with indented surfaces flew better than those with smooth surfaces. Hand-hammered gutta-percha golf balls could be purchased at least by the 1860's, and golf balls with brambles (bumps rather than dents) were in style from the late 1800's to 1908. In 1908, an Englishman, William Taylor, received a British patent for a golf ball with indentations (dimples) that flew better and more accurately than golf balls with brambles. A.G. Spalding & Brothers purchased the U.S. rights to the patent (embodied possibly in U.S. Pat. No. 1,286,834 issued in 1918) and introduced the GLORY ball featuring the TAYLOR dimples. Until the 1970s, the GLORY ball, and most other golf balls with dimples had 336 dimples of the same size using the same pattern, the ATTI pattern. The ATTI pattern was an octahedron pattern, split into eight concentric straight line rows, which was named after the main producer of molds for golf balls.

The only innovation related to the surface of a golf ball during this sixty year period came from Albert Penfold who invented a mesh-pattern golf ball. This pattern was invented in 1912 and was accepted until the 1930's. A combination of a mesh pattern and dimples is disclosed in Young, U.S. Pat. No. 2,002,726, for a Golf Ball, which issued in 1935.

The traditional golf ball, as readily accepted by the consuming public, is spherical with a plurality of dimples, with each dimple having a circular cross-section. Many golf balls have been disclosed that break with this tradition, however, for the most part these non-traditional golf balls have been commercially unsuccessful.

Most of these non-traditional golf balls still attempt to adhere to the Rules Of Golf as set forth by the United States Golf Association ("USGA") and The Royal and Ancient Golf Club of Saint Andrews ("R&A"). As set forth in Appendix III of the Rules of Golf, the weight of the ball shall not be greater than 1.620 ounces avoirdupois (45.93 gm), the diameter of the ball shall be not less than 1.680 inches (42.67 mm) which is satisfied if, under its own weight, a ball falls through a 1.680 inches diameter ring gauge in fewer than 25 out of 100 randomly selected positions, the test being carried out at a temperature of 23±1° C., and the ball must not be designed, manufactured or intentionally modified to have properties which differ from those of a spherically symmetrical ball.

One example is Kennedy, III, U.S. Pat. No. 6,626,772 for a Golf Ball With Elevated Dimple Portions, which discloses surface pattern having dimples with an elevated annular portion within a dimple that preferably extends above the phantom sphere surface of the golf ball.

Another example is Murphy et al., U.S. Pat. No. 6,503,158, for a Dual Non-Circular Dimple For Golf Balls, which discloses a golf ball with dimples having a first non-circular portion having a first depth and a second non-circular portion having a second depth.

Another example is Green et al., U.S. Pat. No. 6,475,106 for a Golf Ball With Grooved Dimples, which discloses a golf ball with dimples having concentric grooves.

Another example is Sullivan, U.S. Pat. No. 6,139,448 for a Golf Ball With Elevated Dimple Portions, which discloses surface pattern having dimples with an elevated annular portion within a dimple that preferably extends above the phantom sphere surface of the golf ball or an elevated annular portion of an outer diameter of a dimple.

Another example is Barfield, U.S. Pat. No. 6,315,686 for Golf Ball Dimple Structures With Vortex Generators, which discloses a golf ball with dimples having ridge like polygons within the dimple to generate a turbulent boundary layer.

Another example of a non-traditional golf ball is Pocklington, U.S. Pat. No. 5,536,013 for a Golf Ball, which discloses a golf ball having raised portions within each dimple, and also discloses dimples of varying geometric shapes, such as squares, diamonds and pentagons. The raised portions in each of the dimples of Pocklington assist in controlling the overall volume of the dimples.

Another example is Kobayashi, U.S. Pat. No. 4,787,638 for a Golf Ball, which discloses a golf ball having dimples with indentations within each of the dimples. The indentations in the dimples of Kobayashi are to reduce the air pressure drag at low speeds in order to increase the distance.

Yet another example is Treadwell, U.S. Pat. No. 4,266,773 for a Golf Ball, which discloses a golf ball having rough bands and smooth bands on its surface in order to trip the boundary layer of air flow during flight of the golf ball.

A variation on this theme is set forth in Moriyama et al., U.S. Pat. No. 5,722,903, for a Golf Ball, which discloses a golf ball with traditional dimples and oval-shaped dimples.

A further example of a non-traditional golf ball is set forth in Shaw et al., U.S. Pat. No. 4,722,529, for Golf Balls, which discloses a golf ball with dimples and 30 bald patches in the shape of a dumbbell for improvements in aerodynamics.

Another example of a non-traditional golf ball is Cadorniga, U.S. Pat. No. 5,470,076, for a Golf Ball, which discloses each of a plurality of dimples having an additional recess. It is believed that the major and minor recess dimples of Cadorniga create a smaller wake of air during flight of a golf ball.

Another example is Sullivan, U.S. Pat. No. 6,569,038 for Golf Ball Dimples, which discloses a golf ball with dimples having sub-dimples.

Another example is Aoyama, U.S. Pat. No. 6,749,525 for Golf Ball Dimples, which discloses dimples comprising a plurality of lobes.

Oka et al., U.S. Pat. No. 5,143,377, for a Golf Ball, discloses circular and non-circular dimples. The non-circular dimples are square, regular octagonal and regular hexagonal. The non-circular dimples amount to at least forty percent of the 332 dimples on the golf ball. These non-circular dimples of Oka have a double slope that sweeps air away from the periphery in order to make the air turbulent.

Machin, U.S. Pat. No. 5,377,989, for Golf Balls With Isodiametrical Dimples, discloses a golf ball having dimples with an odd number of curved sides and arcuate apices to reduce the drag on the golf ball during flight.

Lavallee et al., U.S. Pat. No. 5,356,150, discloses a golf ball having overlapping elongated dimples to obtain maximum dimple coverage on the surface of the golf ball.

Oka et al., U.S. Pat. No. 5,338,039, discloses a golf ball having at least forty percent of its dimples with a polygonal shape. The shapes of the Oka golf ball are pentagonal, hexagonal and octagonal.

Ogg, U.S. Pat. No. 6,290,615 for a Golf Ball Having A Tubular Lattice Pattern discloses a golf ball with a non-dimple aerodynamic pattern.

BRIEF SUMMARY OF THE INVENTION

One aspect of the present invention is a golf ball having a core and a cover layer. The cover layer is disposed over the core. The cover layer has a thickness ranging from 0.010 inch to 0.100 inch. The cover layer has a plurality of primary dimples, with each of the plurality of primary dimples having an annular tubular portion within a dimple surface region of each of the plurality of primary dimples.

Another aspect of the present invention is a golf ball with 332 primary dimples. The golf ball has a core and a cover layer disposed over the core. The cover layer has a thickness ranging from 0.010 inch to 0.100 inch. Each of the primary dimples has an annular tubular portion within a dimple surface region of each of the plurality of primary dimples. The primary dimples consist of twenty different dimple types varying in at least one of diameter, edge angle and chord depth. Each of the primary dimples has a chord depth ranging from 0.170 inch and 0.185 inch, and each annular tubular portion has a height ranging from 0.0015 inch to 0.025 inch.

Yet another aspect of the present invention is a golf ball having a core, a boundary layer disposed over the core, and a cover layer disposed over the boundary layer. The cover layer has a thickness ranging from 0.010 inch to 0.100 inch. The cover layer has a plurality of primary dimples, each having an annular tubular portion within a dimple surface region. The plurality of primary dimples consist of 332 dimples of twenty different dimple types varying in at least one of diameter, edge angle and chord depth. Each of the plurality of primary dimples has a chord depth ranging from 0.170 inch and 0.185 inch, and each annular tubular portion has a height ranging from 0.0015 inch to 0.025 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
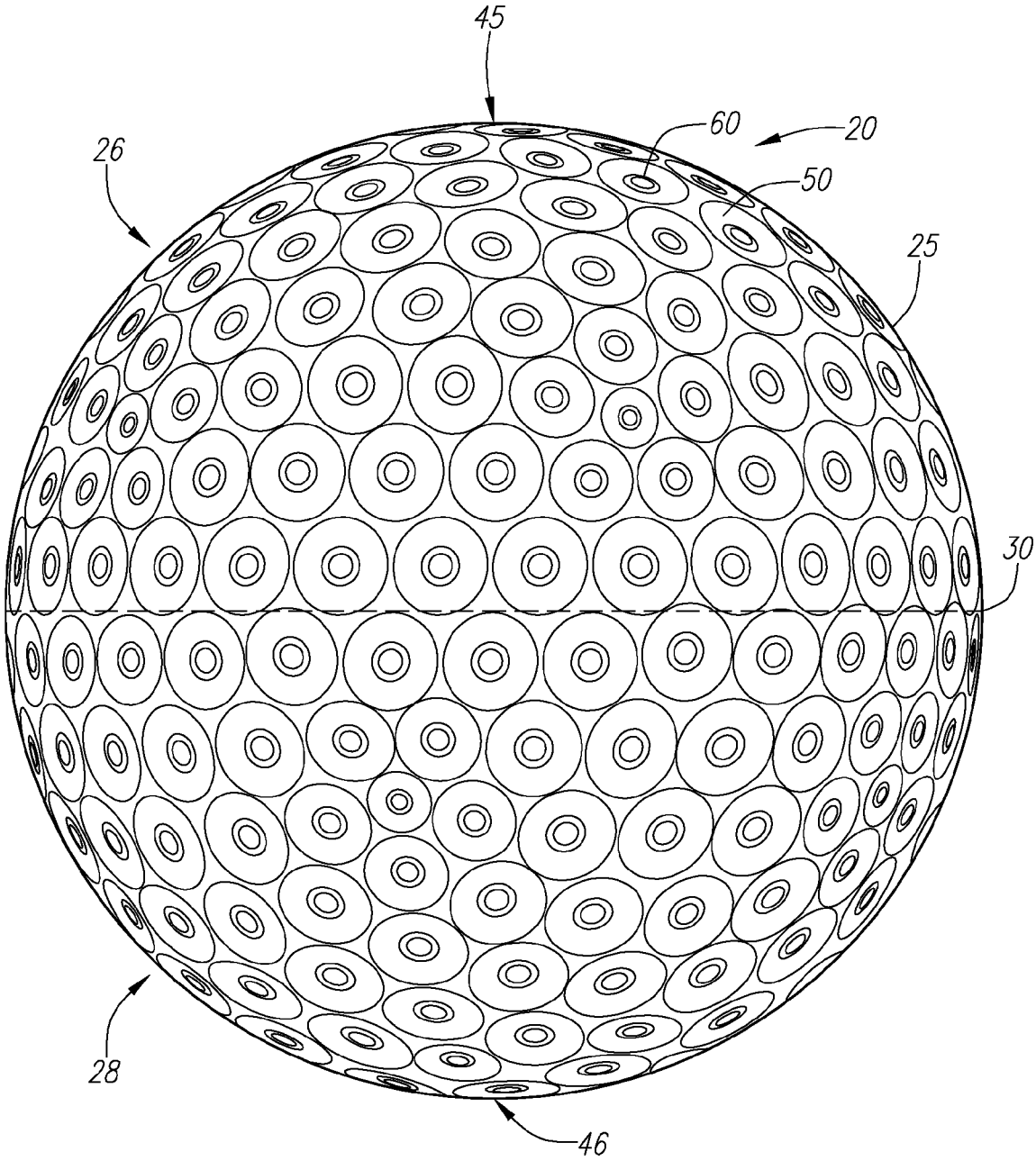
FIG. 1 is an equatorial view of a golf ball of the present invention.
Figure 2:
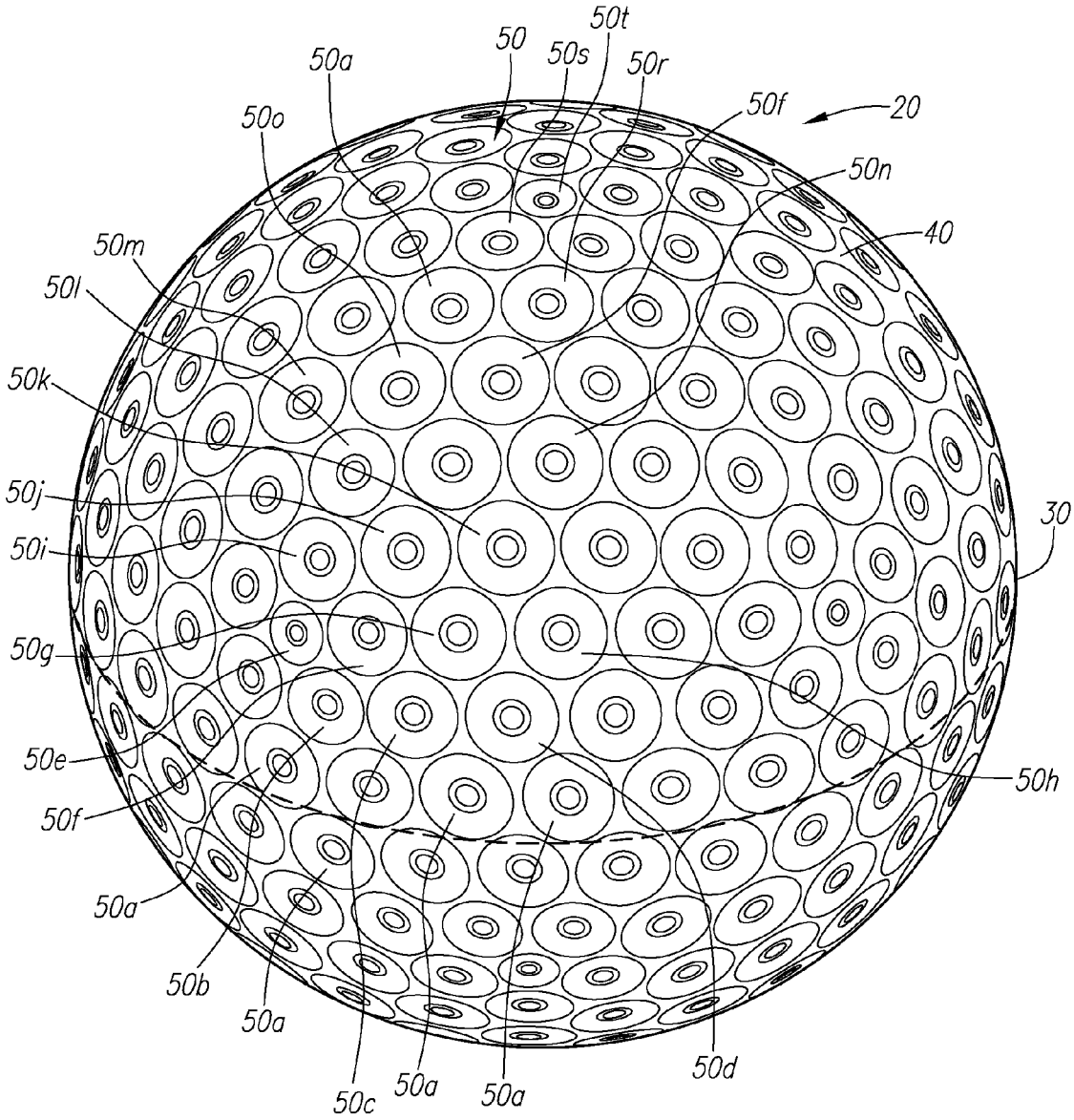
FIG. 2 is a top perspective view of a golf ball of the present invention.
Figure 3:
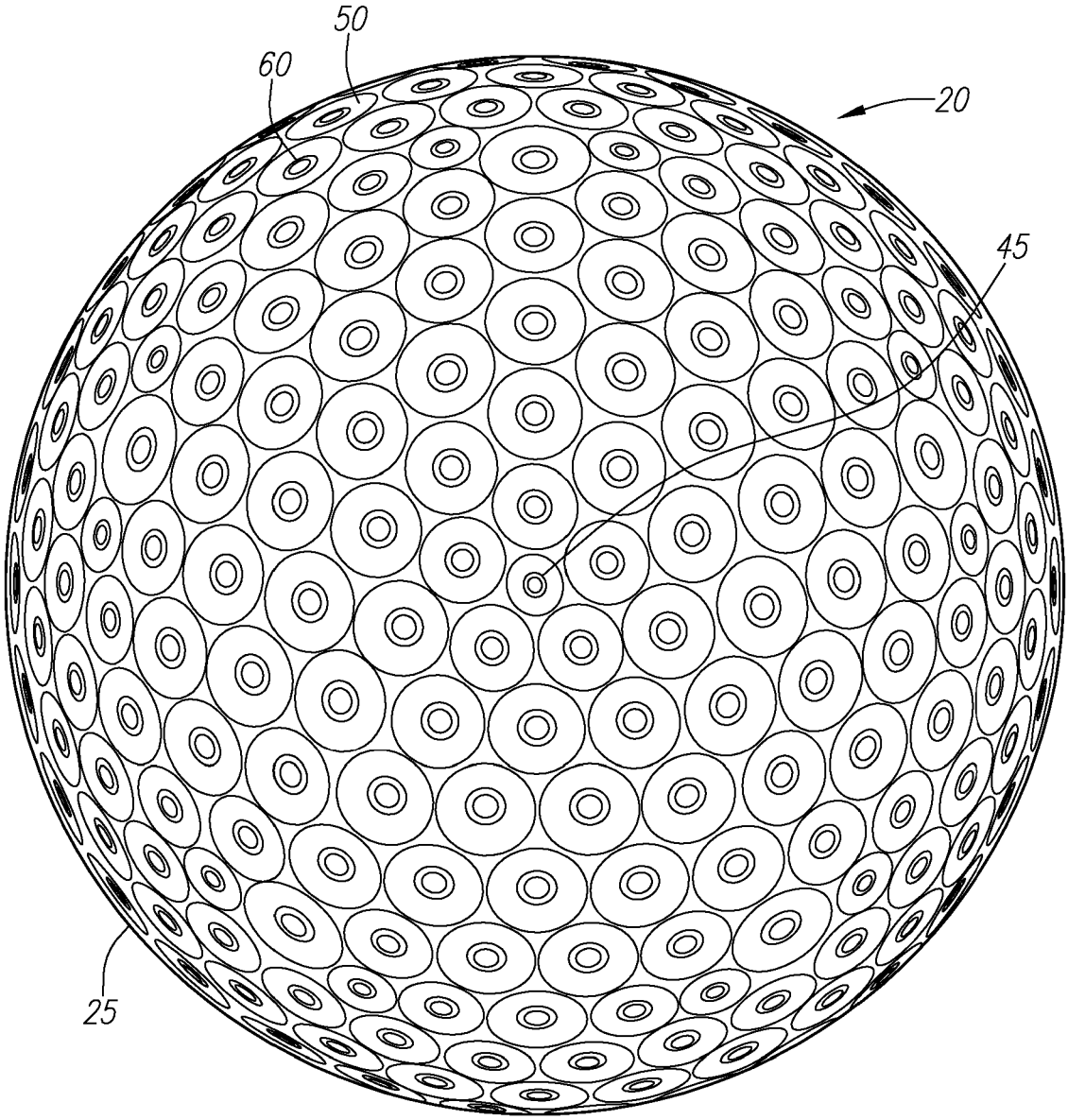
FIG. 3 is a polar view of a golf ball of the present invention.

As shown in FIGS. 1-4, a golf ball is generally designated 20. The golf ball 20 may be a two-piece golf ball, a three-piece golf ball, or a multi-layer golf ball with more than three layers. The construction of the golf ball is discussed in greater detail below.

The golf ball 20 has a surface 25. The golf ball 20 also has an equator 30 dividing the golf ball 20 into a first hemisphere 26 and a second hemisphere 28. A first pole 45 is located ninety degrees along a longitudinal arc from the equator 30 in the first hemisphere 26. A second pole 46 is located ninety degrees along a longitudinal arc from the equator 30 in the second hemisphere 28.

On the surface 25, there are preferably 332 primary dimples 50 partitioned into twenty different sets of primary dimples 50*a*-50*t*. Each of the primary dimples has an annular tubular portion 60 within the dimple surface area 55 of the primary dimple 50. Each of the annular tubular portions 60 lies below a chord depth of its primary dimple 50. The annular tubular portion also partitions the dimple surface area 55 into an outer dimple surface area 55*b* and an inner dimple surface area 55*a*.

A first set of dimples 50*a* are the most numerous dimples consisting of sixty dimples in the preferred embodiment. Table One provides a list of the primary dimples of the preferred embodiment. Table Two provides a list of an alternative embodiment. Each of the twenty different primary dimples vary in diameter, chord depth and/or entry angle. The two polar primary dimples 50*t* are the smallest diameter at 3.04 millimeters ("mm"). In a preferred embodiment, the 332 dimples account for approximately 86% of the surface 25 of the golf ball.

Figure 5:
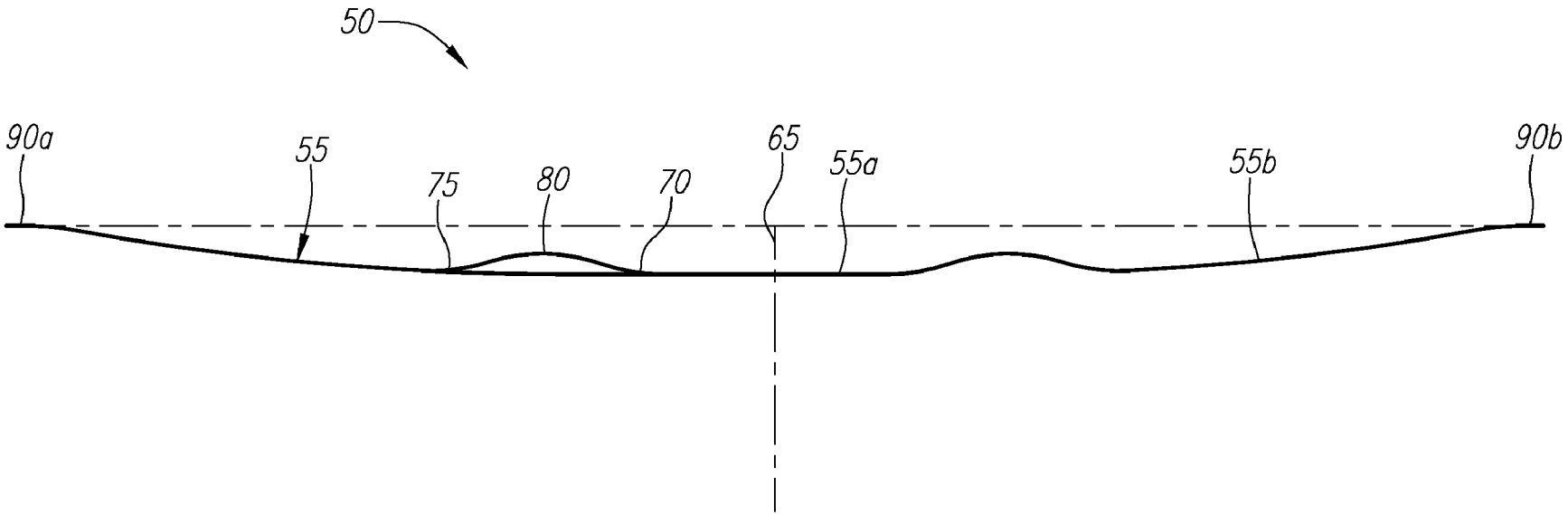
FIG. 5 an isolated cross-sectional view of a dual dimple of the golf ball of the present invention.
Figure 6:
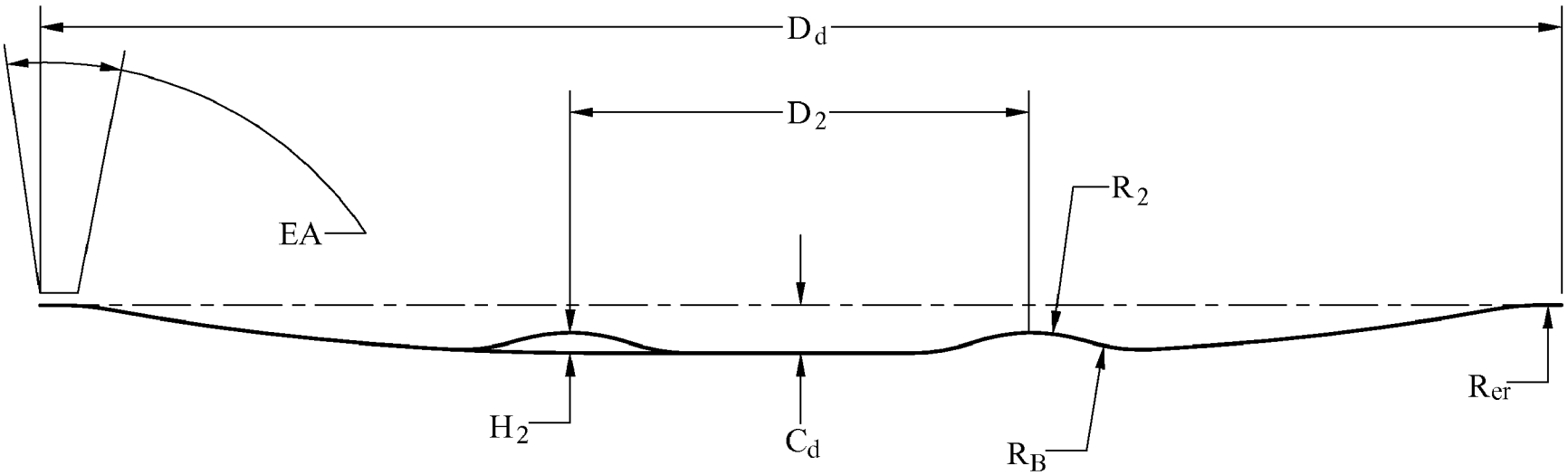
FIG. 6 an isolated cross-sectional view of a dual dimple of the golf ball of the present invention.
Figure 7:
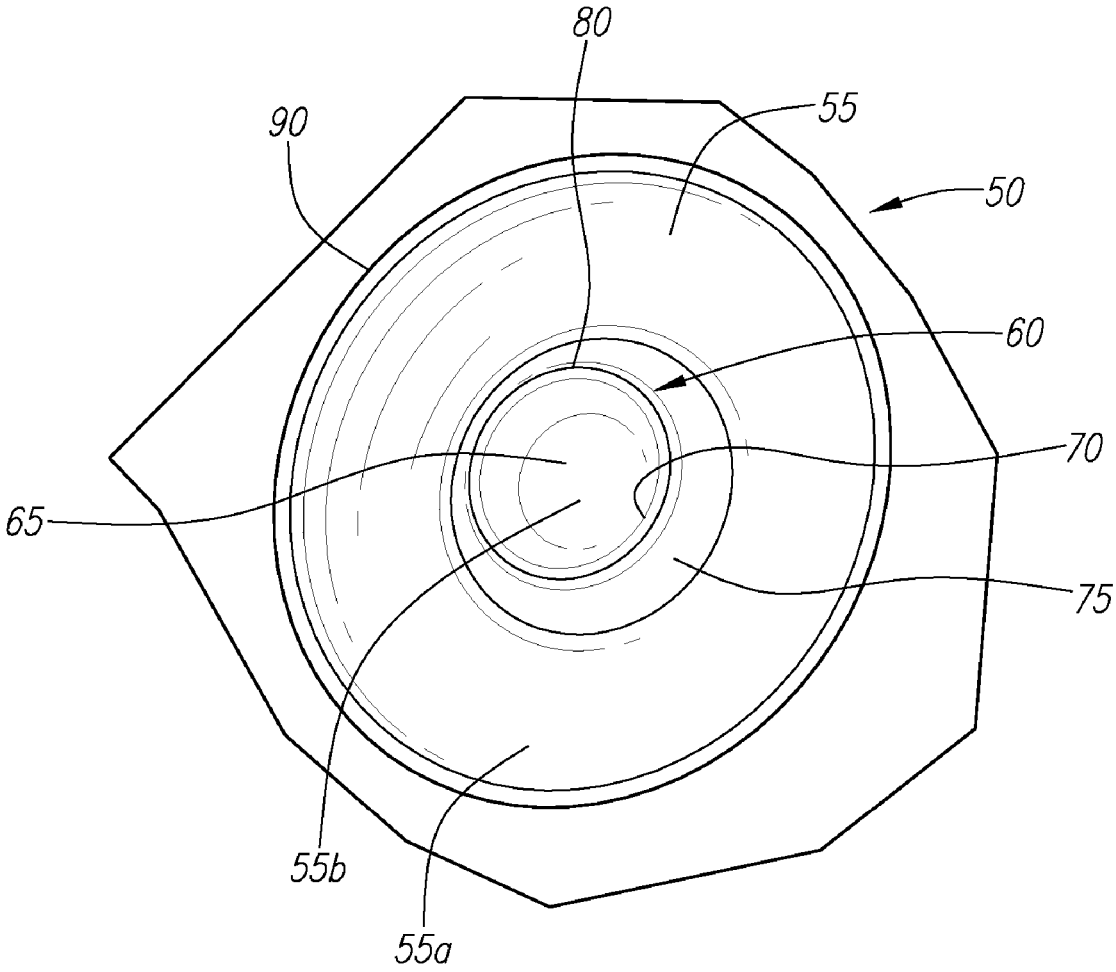
FIG. 7 is an isolated top plan view of a dual dimple.

A cross-section of a primary dimple 50 and annular tubular portion 60 is shown in FIGS. 5 and 6. As shown in FIG. 5, edges 90*a* and 90*b* of the primary dimple 50 define the primary dimple 50. The edge 90 is where the surface 25 transitions from the land area 40 to a primary dimple 50. The annular tubular portion 60 extends outward from the dimple surface area 55 beginning at an outer annular tubular portion edge 75 and ending at an inner annular tubular portion edge 70. An apex 80 of the secondary dimple is the greatest extent of the annular tubular portion 60 from the dimple surface area 55. A lowest point of the dimple surface area 55 is generally designated 65 and point 65 is the center of the primary dimple 50 and the annular tubular portion 60.

As shown in FIG. 6, Dd is the diameter of the primary dimple 50, form one edge 90*a* to another edge 90*b*. As shown in Table One, the diameter of the primary dimple 50 generally ranges from 3 mm to 5 mm, and more preferably from 3.0 mm to 4.7 mm, with the majority of primary dimples 50 of the preferred embodiment having diameters from 4.4 mm to 4.6 mm.

$D_2$ represents the diameter of the annular tubular portion 60, and generally ranges from 0.013 mm to 0.02 mm. $H_2$ represents the height or extension of the annular tubular portion 60, which preferably ranges from 0.0005 mm to 0.0007 mm. EA represents the entry angle for the primary dimple 50. As shown in Table One, the entry angle ranges from 15 to 18 degrees for the preferred embodiment, and most preferably from 16.2 to 17.7 degrees. $C_d$ represents the chord depth of the primary dimple 50, and preferably ranges from 0.13 mm to 0.19 mm, and most preferably from 0.14 mm to 0.16 mm. $R_B$ represents the blend radius of the annular tubular portion 60 which is preferably 0.05 mm. $R_{er}$ represents the edge radius of the primary dimple 50 which is preferably 0.06 mm. $R_R$ represents the tube radius of the annular tubular portion 60 which is preferably 0.5 mm.

TABLE ONE

| Dimple | Numerical Count | Diameter (mm) | Chord Depth (mm) | Entry Angle (degrees) |
|---|---|---|---|---|
| 1 (50a) | 60 | 4.42 | 0.151 | 17.60 |
| 2 (50b) | 20 | 3.86 | 0.150 | 17.35 |
| 3 (50c) | 20 | 4.51 | 0.150 | 17.32 |
| 4 (50d) | 20 | 4.47 | 0.149 | 17.31 |
| 5 (50e) | 10 | 3.00 | 0.148 | 17.16 |
| 6 (50f) | 20 | 3.91 | 0.148 | 17.10 |
| 7 (50g) | 20 | 4.51 | 0.148 | 17.05 |
| 8 (50h) | 10 | 4.51 | 0.148 | 17.05 |
| 9 (50i) | 10 | 3.96 | 0.147 | 16.94 |
| 10 (50j) | 20 | 4.51 | 0.146 | 16.85 |
| 11 (50k) | 20 | 4.51 | 0.146 | 16.80 |
| 12 (50l) | 10 | 4.51 | 0.145 | 16.71 |
| 13 (50m) | 20 | 4.62 | 0.145 | 16.62 |
| 14 (50n) | 10 | 4.62 | 0.145 | 16.59 |
| 15 (50o) | 10 | 4.51 | 0.144 | 16.50 |
| 16 (50p) | 20 | 4.51 | 0.144 | 16.44 |
| 17 (50q) | 10 | 4.51 | 0.143 | 16.35 |
| 18 (50r) | 10 | 4.47 | 0.143 | 16.32 |
| 19 (50s) | 10 | 4.43 | 0.142 | 16.27 |
| 20 (50t) | 2 | 3.04 | 0.142 | 16.24 |

TABLE TWO

| Dimple | Numerical Count | Diameter (mm) | Chord Depth (mm) | Entry Angle (degrees) |
|---|---|---|---|---|
| 1 (50a) | 60 | 4.42 | 0.182 | 17.10 |
| 2 (50b) | 20 | 3.86 | 0.180 | 16.85 |
| 3 (50c) | 20 | 4.51 | 0.179 | 16.82 |
| 4 (50d) | 20 | 4.47 | 0.179 | 16.82 |
| 5 (50e) | 10 | 3.00 | 0.178 | 16.66 |
| 6 (50f) | 20 | 3.91 | 0.178 | 16.60 |
| 7 (50g) | 20 | 4.51 | 0.178 | 16.55 |
| 8 (50h) | 10 | 4.51 | 0.178 | 16.55 |
| 9 (50i) | 10 | 3.96 | 0.177 | 16.44 |
| 10 (50j) | 20 | 4.51 | 0.177 | 16.35 |
| 11 (50k) | 20 | 4.51 | 0.176 | 16.30 |
| 12 (50l) | 10 | 4.51 | 0.176 | 16.21 |
| 13 (50m) | 20 | 4.62 | 0.175 | 16.12 |
| 14 (50n) | 10 | 4.62 | 0.175 | 16.09 |
| 15 (50o) | 10 | 4.51 | 0.174 | 16.00 |
| 16 (50p) | 20 | 4.51 | 0.174 | 15.94 |
| 17 (50q) | 10 | 4.51 | 0.173 | 15.85 |
| 18 (50r) | 10 | 4.47 | 0.173 | 15.82 |
| 19 (50s) | 10 | 4.43 | 0.172 | 15.77 |
| 20 (50t) | 2 | 3.04 | 0.172 | 15.74 |

In one embodiment, the golf ball 20 is constructed as set forth in U.S. Pat. No. 6,117,024, for a Golf Ball With A Polyurethane Cover, which pertinent parts are hereby incorporated by reference. The golf ball 20 has a coefficient of restitution at 143 feet per second greater than 0.7964, and an USGA initial velocity less than 255.0 feet per second. The preferred golf ball 20 has a COR of approximately 0.8152 at 143 feet per second, and an initial velocity between 250 feet per second to 255 feet per second under USGA initial velocity conditions. A more thorough description of a high COR golf ball is disclosed in U.S. Pat. No. 6,443,858, which pertinent parts are hereby incorporated by reference.

Additionally, a core 12 of the golf ball 20 may be solid, hollow, or filled with a fluid, such as a gas or liquid, or have a metal mantle. The cover of the golf ball 20 may be any suitable material. A preferred cover for a three-piece golf ball is composed of a thermoset polyurethane material. Alternatively, the cover may be composed of a thermoplastic polyurethane, ionomer blend, ionomer rubber blend, ionomer and thermoplastic polyurethane blend, or like materials. A preferred cover material for a two-piece golf ball is a blend of ionomers. Alternatively, the golf ball 20 may have a thread layer. Those skilled in the pertinent art will recognize that other cover materials may be utilized without departing from the scope and spirit of the present invention. The golf ball 20 may have a finish of one or two basecoats and/or one or two top coats.

Figure 4:
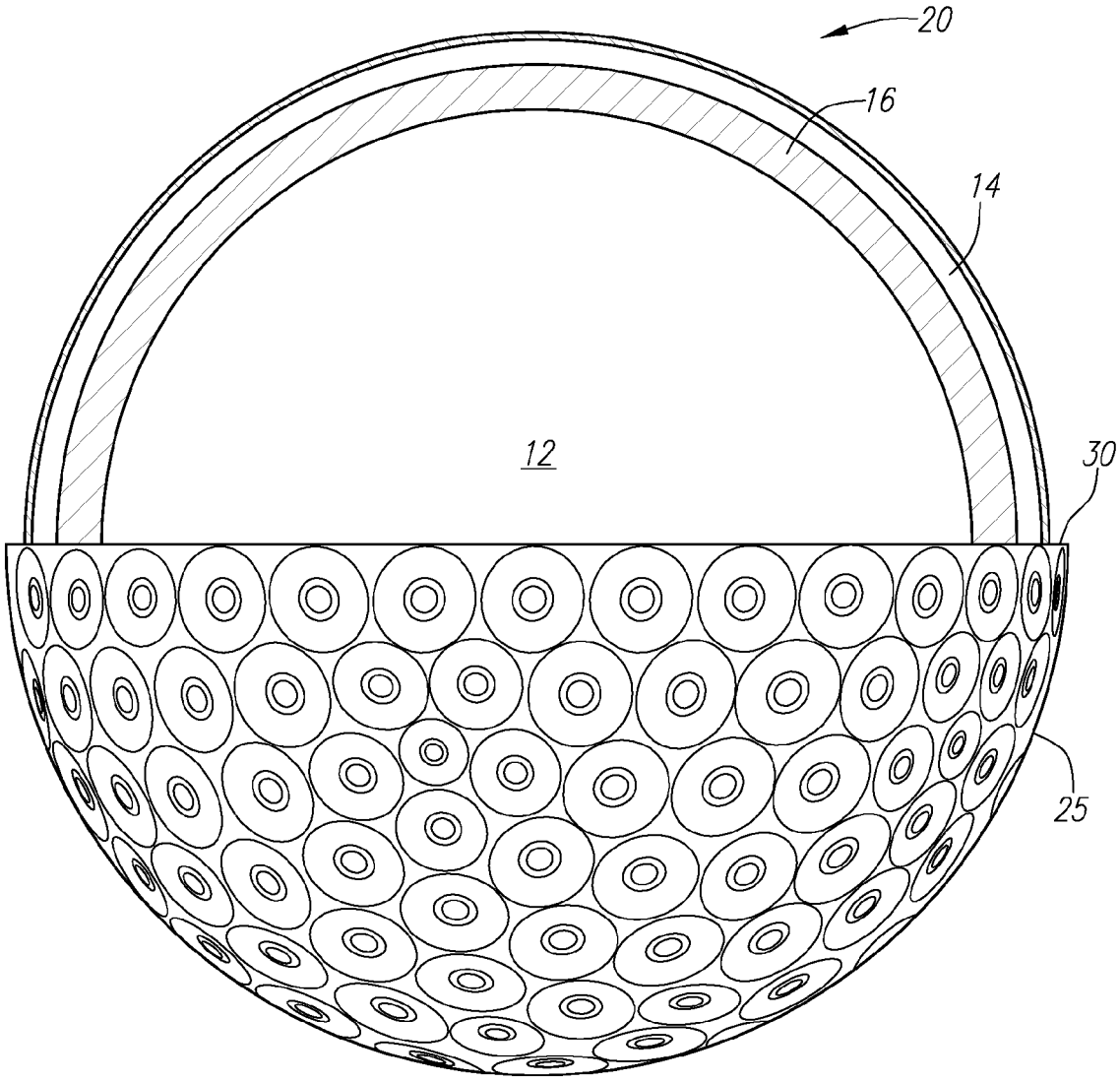
FIG. 4 is a partial sectional view of a golf ball of the present invention.

In an alternative embodiment of a golf ball 20, with the construction as shown in FIG. 4, the boundary layer 16 or cover layer 14 is comprised of a high acid (i.e. greater than 16 weight percent acid) ionomer resin or high acid ionomer blend. More preferably, the boundary layer 16 is comprised of a blend of two or more high acid (i.e. greater than 16 weight percent acid) ionomer resins neutralized to various extents by different metal cations.

Another embodiment of the boundary layer 16 comprises a non-ionomeric thermoplastic material or thermoset material. Suitable non-ionomeric materials include, but are not limited to, metallocene catalyzed polyolefins or polyamides, polyamide/ionomer blends, polyphenylene ether/ionomer blends, etc., which preferably have a Shore D hardness of at least 60 (or a Shore C hardness of at least about 90) and a flex modulus of greater than about 30,000 psi, preferably greater than about 50,000 psi, or other hardness and flex modulus values which are comparable to the properties of the ionomers described above. Other suitable materials include but are not limited to, thermoplastic or thermosetting polyurethanes, thermoplastic block polyesters, for example, a polyester elastomer such as that marketed by DuPont under the brand HYTREL, or thermoplastic block polyamides, for example, a polyether amide such as that marketed by Elf Atochem S. A. under the brand PEBEX, a blend of two or more non-ionomeric thermoplastic elastomers, or a blend of one or more ionomers and one or more non-ionomeric thermoplastic elastomers. These materials can be blended with the ionomers described above in order to reduce cost relative to the use of higher quantities of ionomer.

In one embodiment, the cover layer 14 is comprised of a relatively soft, low flex modulus (about 500 psi to about 50,000 psi, preferably about 1,000 psi to about 25,000 psi, and more preferably about 5,000 psi to about 20,000 psi) material or blend of materials. Preferably, the cover layer 14 comprises a polyurethane, a polyurea, a blend of two or more polyurethanes/polyureas, or a blend of one or more ionomers or one or more non-ionomeric thermoplastic materials with a polyurethane/polyurea, preferably a thermoplastic polyurethane or reaction injection molded polyurethane/polyurea (described in more detail below).

The cover layer 14 preferably has a thickness in the range of 0.005 inch to about 0.15 inch, more preferably about 0.010 inch to about 0.050 inch, and most preferably 0.015 inch to 0.025 inch. In one embodiment, the cover layer 14 has a Shore D hardness of 60 or less (or less than 90 Shore C), and more preferably 55 or less (or about 80 Shore C or less). In another preferred embodiment, the cover layer 14 is comparatively harder than the boundary layer 16.

Further descriptions of suitable RIM systems is disclosed in U.S. Pat. No. 6,663,508, which pertinent parts are hereby incorporated by reference.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf ball comprising:

a plurality of primary dimples, each of the plurality of primary dimples having a dimple surface, each of the plurality of primary dimples having a diameter ranging from 3 mm to 5 mm, each of the plurality of primary dimples having a chord depth ranging from 0.13 mm to 0.19 mm, each of the plurality of primary dimples having an annular tubular portion extending outward from the dimple surface, the annular tubular portion having a diameter ranging from 0.013 mm to 0.02 mm and a height ranging from 0.0005 mm to 0.0007 mm;

wherein the plurality of primary dimples covers 81% to 87% of a surface of the golf ball.

2. The golf ball according to claim 1 wherein the plurality of primary dimples comprises 332 primary dimples.

3. The golf ball according to claim 1 wherein the golf ball has a coefficient of restitution at 143 feet per second greater than 0.7964, and an USGA initial velocity less than 255.0 feet per second.

* * * * *